US005403118A

United States Patent [19]

Davis et al.

[11] Patent Number: 5,403,118

[45] Date of Patent: Apr. 4, 1995

[54] OPTIMUM WATER RETENTION SYSTEM FOR USE IN AGRICULTURAL FIELDS

[76] Inventors: Michael K. Davis, 4002 Aspen St., Bryan, Tex. 77801; Dick D. Davis, 5245 Singer Rd., Las Cruces, N. Mex. 88005

[21] Appl. No.: 986,110

[22] Filed: Dec. 4, 1992

[51] Int. Cl.[6] ..... E02B 11/00; E02B 13/00

[52] U.S. Cl. ..... 405/36; 405/50

[58] Field of Search ..... 405/36, 37, 38, 39, 405/40, 41, 43, 44, 50, 51

[56] References Cited

U.S. PATENT DOCUMENTS

| | | | |
|---|---|---|---|
| 319,297 | 6/1885 | Montenegro . | |
| 625,860 | 5/1899 | Thornton . | |
| 680,738 | 8/1901 | Serrazanetti . | |
| 867,157 | 9/1907 | Richter . | |
| 921,513 | 5/1909 | Crawford . | |
| 1,083,148 | 12/1913 | Sparks . | |
| 1,878,383 | 9/1932 | Crouse . | |
| 2,077,307 | 4/1937 | Bumpas et al. . | |
| 2,223,360 | 12/1940 | Ellis | 405/51 X |
| 2,745,768 | 5/1956 | Karch . | |
| 3,218,810 | 11/1965 | Grether et al. . | |
| 3,331,207 | 7/1967 | McGrew et al. . | |
| 3,415,062 | 12/1968 | Ziegenmeyer . | |
| 3,461,675 | 8/1969 | Izatt | 405/38 |
| 3,479,825 | 11/1969 | Hellstrom | 405/36 X |
| 3,705,851 | 12/1972 | Brauer | 405/36 X |
| 3,849,991 | 11/1974 | Niederwemmer | 405/38 |
| 3,894,398 | 7/1975 | Fritz et al. . | |
| 4,073,245 | 2/1978 | Anderson . | |
| 4,184,786 | 1/1980 | Richards . | |
| 4,221,501 | 9/1980 | Saburi | 405/36 X |
| 4,307,975 | 12/1981 | Heitman . | |
| 4,464,079 | 8/1984 | Chance | 405/37 |
| 4,561,801 | 12/1985 | Nantz . | |
| 4,832,526 | 5/1989 | Funkhouser, Jr. | 405/38 X |
| 4,876,004 | 10/1989 | Verhoeff . | |
| 4,948,294 | 8/1990 | Mercier | 405/36 X |
| 4,973,196 | 11/1990 | Fuhr et al. | 405/36 X |
| 5,039,251 | 8/1991 | Schlueter et al. | 405/51 X |
| 5,059,064 | 10/1991 | Justice | 405/37 |

*Primary Examiner*—Randolph A. Reese
*Assistant Examiner*—John Ricci
*Attorney, Agent, or Firm*—Mark A. Oathout

[57] ABSTRACT

The invention is for an optimum water and soil retention system for use in an agricultural field, which includes watershed units having a basin, borders located on opposite sides of the basin, an ingress and an egress weir located at opposite ends of the basin. The top surface of the ingress weir is below the top surface of the borders at the point where the ingress weir intersects the borders. The top surface of the egress weir is nearly always below the level of the ingress weir. The watershed units are arranged consecutively end to end to form a string, which normally runs from a high point in the field to a low point or drainageway. The field is divided into collateral strings thus creating a complete and systematic field of watershed units.

26 Claims, 11 Drawing Sheets

OPTIMUM WATER RETENTION SYSTEM FOR USE IN AGRICULTURAL FIELDS

BACKGROUND OF THE INVENTION

When rain falls on an agricultural field it is normally considered a desirable event. However, there are several problems related to rainfall including the fact that water runs downhill so that the point where the rain falls will not retain all of the direct rainfall. This run-off water carries soil particles with it causing soil erosion (SiH), and other non-point source pollution in the form of agricultural chemicals (herbicides, pesticides and fertilizers) which can be carried with the run-off. In light of these problems soil conservation has become an important issue related to crop yield and pollution.

The purpose of the LANDSAFE process is to hold moisture in the place where it falls and thereby to prevent runoff and water erosion. Thus, through effective moisture retention the twin goals of soil protection and storing additional moisture for crop production are achieved simultaneously. The importance of retaining rainwater on the soil and avoiding runoff and erosion has been recognized for generations by soil experts, but they lacked the means of achieving this goal.

*SOILS AND MEN*, Yearbook of Agriculture 1938, a recognized classic on soils, speaks of runoff and water erosion in these terms (pp. 682–83):

"Water erosion is not so important a factor in dryland sections as in more humid sections, although damage sometimes occurs. The greatest evil is the loss of water that may be vitally needed for crop production. For this reason the prevention of run-off is advocated to increase crop yields rather than to prevent soil loss, although it accomplishes both ends. The entire trend of cultivation has been to hold water where it falls until it penetrates the soil, rather than to lead it from the field in easy stages to prevent washing." (Italics supplied to original text).

A generation later the ultimate goal of holding precipitation in the place where it falls, was the same but still unattainable by the methodology of the age, as stated in *SOIL*, the 1957 Yearbook of Agriculture (p.290):

"We cannot avoid all risks of erosion when we lay a soil bare by cultivating it. Neither can we hold all the rain where it falls in humid and subhumid areas. But we need to know the risks and control them the best we can."

Previous soil conservation programs did a good job in evaluating the risks and achieving a fair measure of control with the technology available at the time. Today the technology exists to process the land in such a way as to attain the ultimate goal of holding the ambient precipitation in the place where it falls, certainly in the arid, semiarid, and subhumid areas and even extending into large portions of the humid regions. This invention relates to a way to prevent runoff and erosion even at the time of year when the soil lies bare between successive crops.

Research indicates that most erosion occurs at vulnerable periods, such as when an intense rainstorm occurs at a time when the soil is unprotected by vegetation, especially during preparation for another crop. A need therefore exists for a system, and methods which will resolve the above identified problems, especially during vulnerable periods.

SUMMARY OF THE INVENTION

The present invention relates to a system and methods for optimum retention of rainfall through the utilization of units sometimes referred to below as microwatershed units or mini watershed units (individually or in the aggregate). When applied systematically throughout the field they shall be referred to as the LANDSAFE TM System. The units are designed to contain and absorb virtually all precipitation near the point where it falls, and to retain nearly all soil particles and adsorbed chemicals within the bounds of the unit. During a major precipitation event, such as a decade or century rainfall the system which is made up of individual watershed units may still contain the precipitation and therefore, the soil particles and chemicals as well. If not, the system is designed to control run-off thereby minimizing erosion and the movement of chemicals.

There are two other important side benefits achieved through this system. The most important of these to the farmer is probably the great increase in farming efficiency which is facilitated by the process. Terrace systems result in small fields and point rows, significantly reducing the efficiency in the handling of modern machinery. The backslopes of terraces can be steep and difficult to till. Normally, even on moderate slopes the grid of LANDSAFE units can be laid out in straight strings that minimize turning and maximize machinery acres per hour by maximizing field size and eliminating point rows.

The aftermath of the storm will reveal another significant difference between the LANDSAFE and the prior systems, in addition to the precipitation lost due to runoff in the conventional terraced and contoured field. Since the LANDSAFE field has distributed the water evenly, the field will dry at a uniform rate, and if the soil type is uniform the entire field can be planted in row crop in a single day operation. With uniform moisture, plant stands can be obtained that are even and uniform throughout the field. Yield prospects are very good. On the field farmed with conventional conservation tillage methods the slopes between terraces dry out first because much of the water runs off of these areas, to accumulate in the terrace channels. Therefore the drier slopes above the terrace are normally planted first. If the terrace channels are planted at the same time the soil will be muddy and the stands poor. It may be days later before the soil in the terrace channels is dry enough for optimum planting, requiring a return trip to the field. The conventional conservation tillage has been a less efficient operation, and yield prospects are reduced by lack of timeliness in the planting, and later the cultivating operations as well as uneven moisture distribution.

The invention is for an optimum water retention system for use in an agricultural field, which includes watershed units preferably having a basin, borders located on opposite sides of the basin, an ingress and an egress weir located at opposite ends of the basin. The top surface of the ingress weir is below the top surface of the borders at the point where the ingress weir intersects the borders. The top surface of the egress weir is nearly always below the level of the ingress weir. The watershed units are arranged consecutively end to end to form a string, which normally runs from a high point in the field to a low point or drainageway. The field is divided into collateral strings thus creating a complete and systematic field of watershed units.

DETAILED DESCRIPTION OF THE INVENTION

Figure 1:
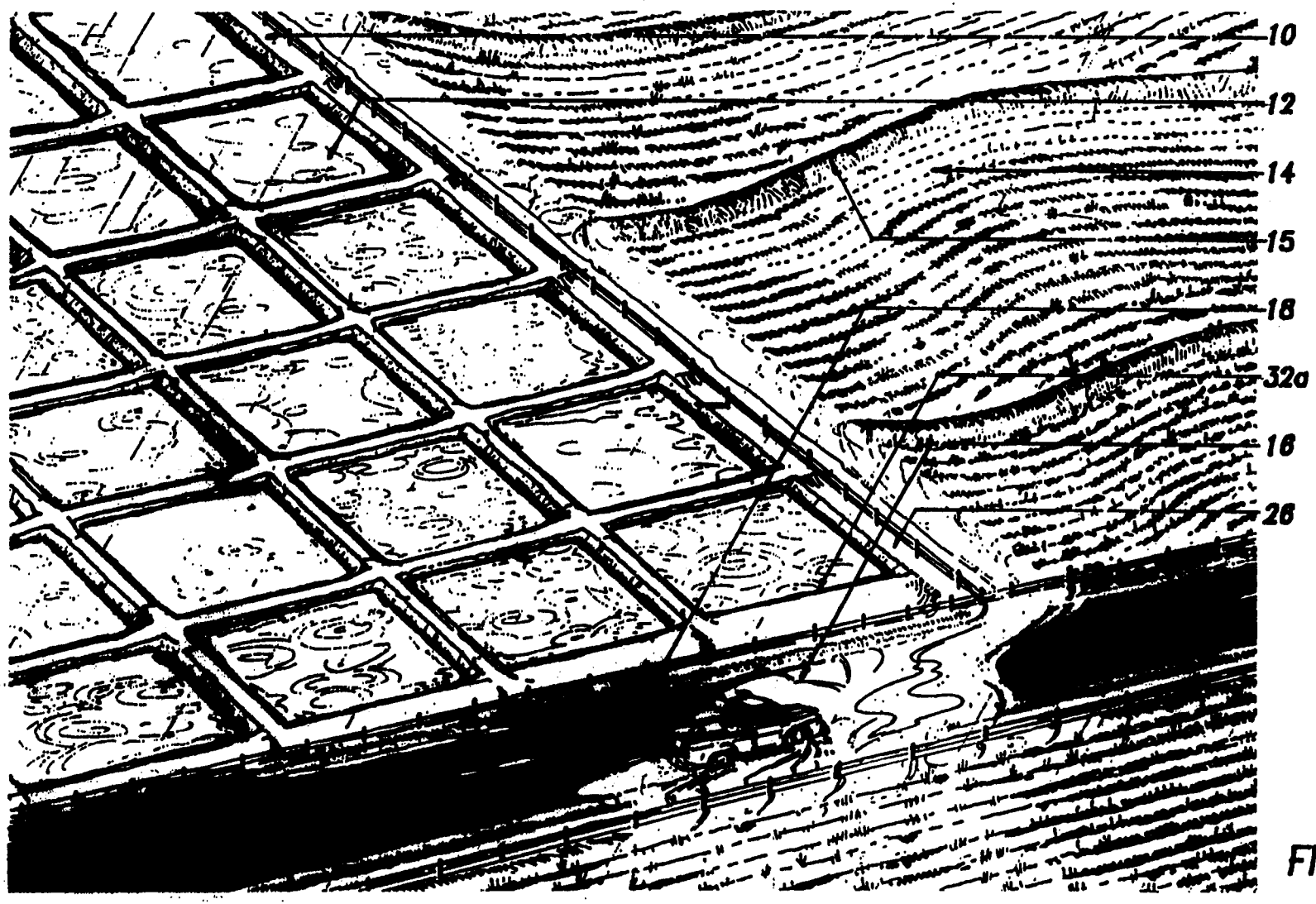
FIG. 1 is a view of the invention implemented into an agricultural field adjacent to a field which has not implemented the invention.

FIG. 1 shows the normal symmetrical grid 10 of the optimal water retention system formed in an agricultural field 12. Rainfall is depicted with the symmetrical grid 10 retaining the direct rainfall water 11. In the adjacent field 14, heavy rain has caused the water to flow downslope and pond beside the fence. Runoff water 16 carrying soil, etc. from the adjacent field 14 is spilling onto a road 18. The most basic function of the system is to permanently subdivide watersheds into manageable units, compatible with equipment or mechanization, that control rainwater to an extent never previously achieved by economical processes.

Figure 2A:
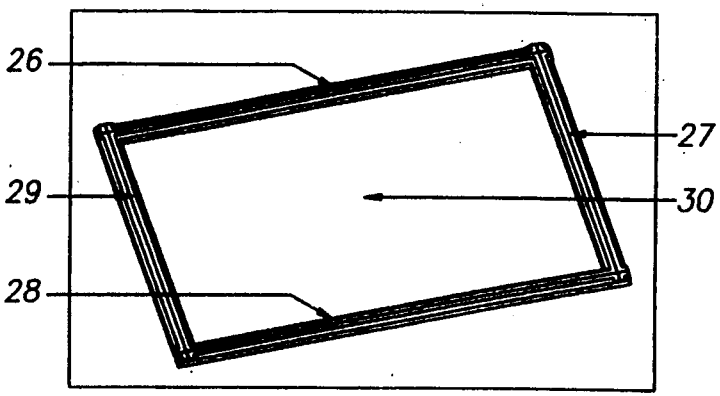
FIG. 2A is a perspective view of another watershed unit embodiment.
Figure 3:
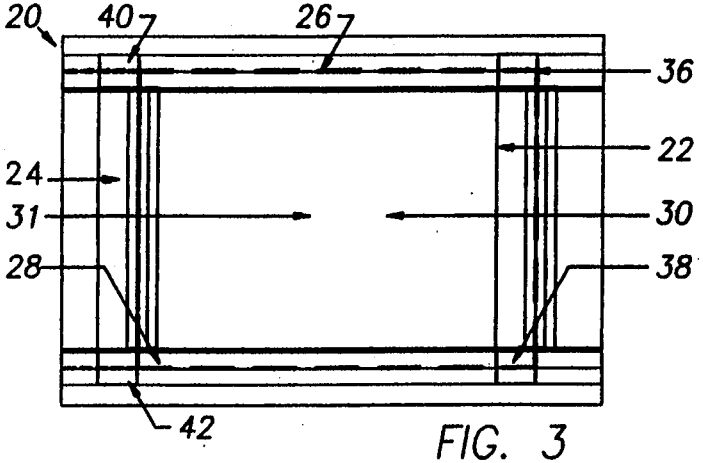
FIG. 3 is a top view of a watershed unit.
Figure 2:
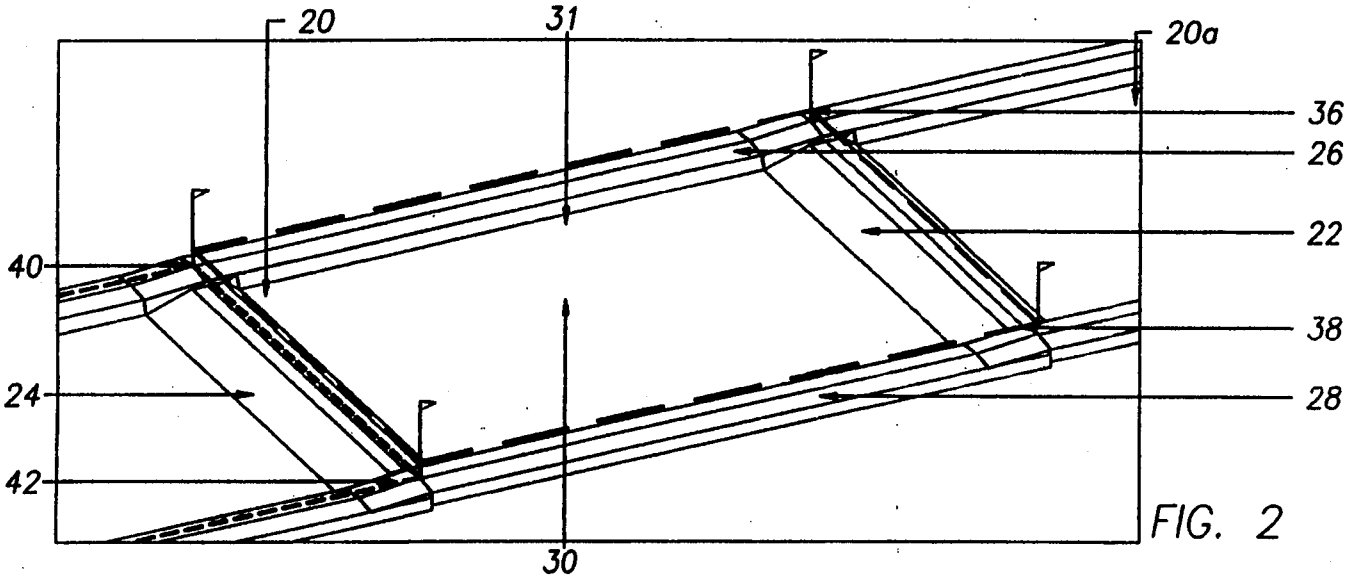
FIG. 2 is a perspective view of a watershed unit.

Referring to FIGS. 2 and 3, at the most fundamental level, the process design begins with the microwatershed or watershed unit 20. These units 20 are planned to contain and absorb virtually all precipitation near the point where it falls, and to retain nearly all soil particles and adsorbed chemicals within the bounds of the unit 20, as specified below. No other relatively inexpensive process is capable of doing this.

The essential elements of a watershed unit 20 are earthen weirs 22, 24, borders 26, 28 and basins 30.

With respect to each unit 20, the upslope weir 22 is an ingress weir, and the downslope weir 24 is the egress weir. Most units 20 share weirs 22, 24 with the units **20*a* and 20*b* immediately above and immediately below them, respectively. Only the leading or upper weir (not shown) of a string 32 at the apex of a slope, and the trailing or lower weir 24*d* (FIGS. 4 and 5) of the string 32 at the bottom of the slope are not shared between adjacent units. In regions where large rains are unlikely and hence rains which may overtop the watershed units 20 are unlikely, no weirs may be needed and four borders 26, 27, 28 and 29** could be utilized (as depicted in FIG. 2A).

Figure 11:
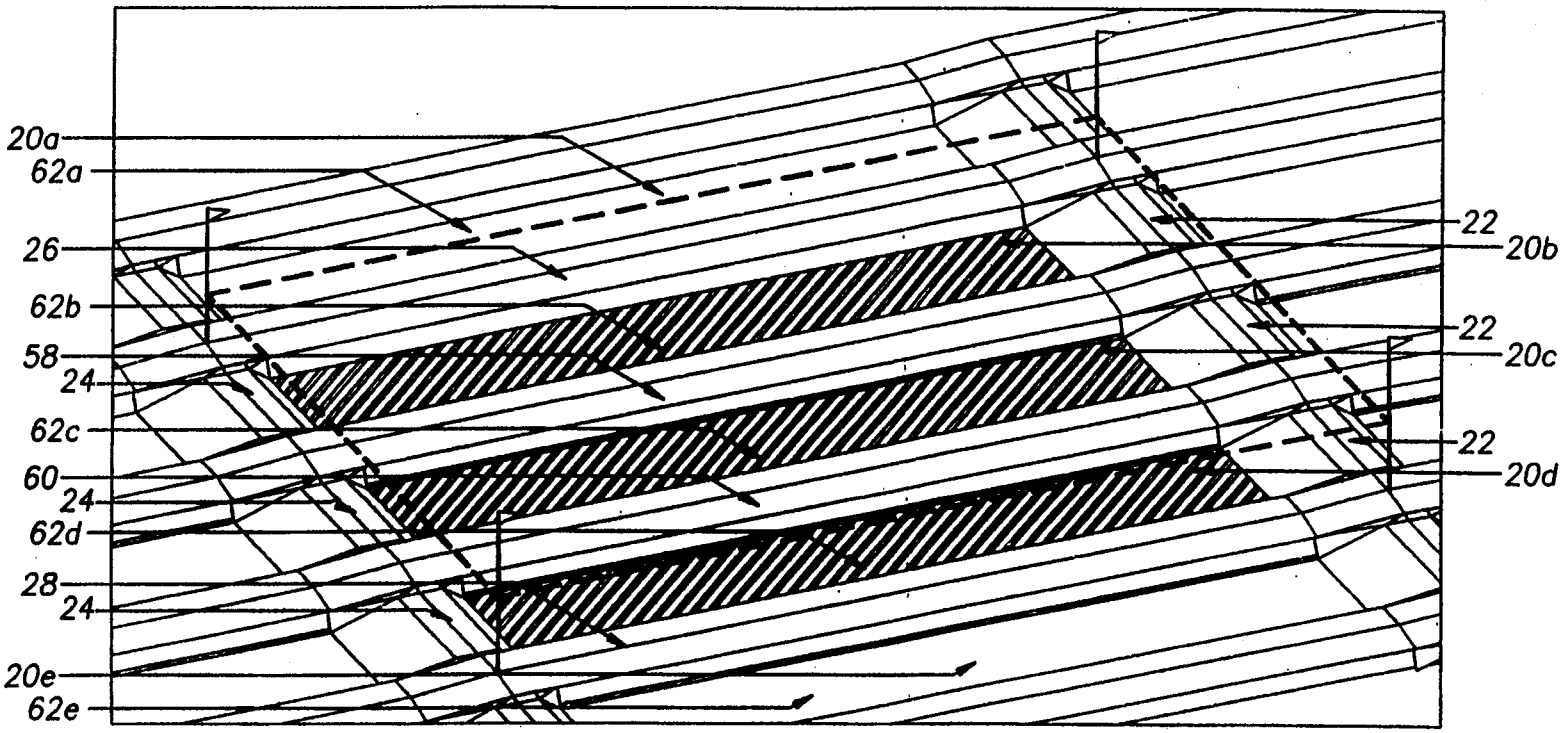
FIG. 11 is a perspective view of another embodiment of the invention where the elevation of the implemented tracks is similar to the elevation of the borders or actually replaces the borders.

Most units 20 share borders 26 and 28 with the units immediately to either side (for example see FIG. 11). Only units in the initial or terminating string **32*a* (FIG. 1)in a field 12 have an unshared border 26. Orientation of the unit 20 will vary according to general topography, slope, general direction of erosive winds, etc. On near level or moderately sloping soils the egress weir 24 can face fully downslope. Steeply sloping soils may require that the egress weir 24 face at an angle to the true downslope direction. In this case, the "downslope" border 28 will also be facing partly downslope. The downslope border 28 of the unit 20 is invariably constructed sufficiently high, so as not to permit water to move out of the side of the unit 20, regardless of the amount of precipitation. In the rare events that result in overflow, water will move out of the unit 20 by way of the egress weir 24. Height of the borders 26 and 28** will vary due to regional average precipitation, soil type, and slope.

Basin(s) 30 occupy most of the internal area bounded by the borders 26, 28 and weirs 22, 24. Basins 30 are normally to be constructed with the longitudinal bottom surface 31 (ingress weir 22 to egress weir 24) as nearly level as possible (an exception for a collection type basin will be described later). Basins 30 are to be constructed of sufficient size (relative to total unit area) and depth so as to have a very high probability of being capable of containing all precipitation impinging upon the micro-watershed unit 20.

Although the internal basins 30 are level; the slope from weir 22-to-weir 24 normally angles slightly downward. The dashed line in FIGS. 2–6 and 9–10 indicates boundaries of a plane surface above the unit 20. This plane is level above the basin 30 in the longitudinal direction (weir 22 to weir 24), and in most cases is also level in cross section (border 26 to border 28). Note that the plane lies flat against the tops 36, 38 of the borders 26, 28 on the upslope side (leading end), but is some distance above the tops 40, 42 of the borders 26, 28 or weir 24 on the downslope side (trailing end). The distance of the egress weir 24 below the level plane is determined by the slope of the land and the length of the individual watershed unit 20.

The amount of basin containment should meet Soil Conservation Service regional standards. In the most arid regions, it may well contain a 100 year rain. At the other extreme, the concept of optimum retention applies for humid regions, where it may sometimes be found desirable to allow excess water to flow over the egress weir 24. The term "optimum retention" is defined as that quantity of water "best suited" to reduce runoff erosion, reduce runoff pollution, and provide drought protection for a specific site (or downslope watershed areas protected by a specific site), while not retaining so much water as to drown or cause lasting damage to on-site crops (not shown but grown in the units 20) in most years. Thus, containment is adjusted for necessary overflow to prevent drowning while retaining sufficient moisture to help sustain crops during moderate summer drought periods.

The concept of the "watershed" implies that in terms of water management, all low lying areas are inexorably linked to the summits and slopes that lie above them. Therefore, by holding copious precipitation on the site where it falls, the domino effect of geometric downslope accumulation is prevented. There are situations where on summit and/or upslope sites it may prove economically feasible to deliberately construct units 20 of sufficient basin 30 dimensions to retain all ambient precipitation, even at the cost of damaging crops on those sites, in order to protect more valuable sites lying below them.

In sub-humid areas optimum retention will be equivalent to complete retention under most conditions.

The length of the basin 30 can be relatively longer where slope is less drastic, and consequently cuts and fills required in the construction of the unit 20 are less; however, if wind erosion is normally a serious problem, the unit 20 should be relatively small.

Figure 4:
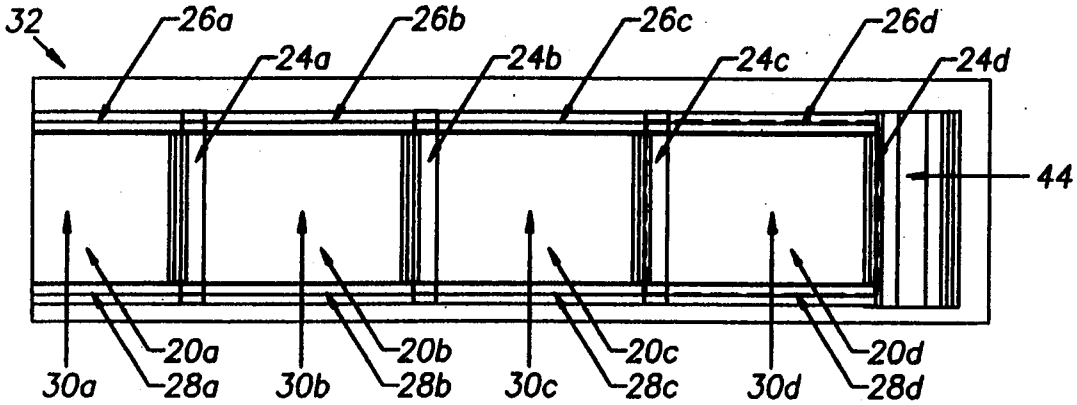
FIG. 4 is a top view of several watershed units consecutively arranged to form a string.
Figure 5:
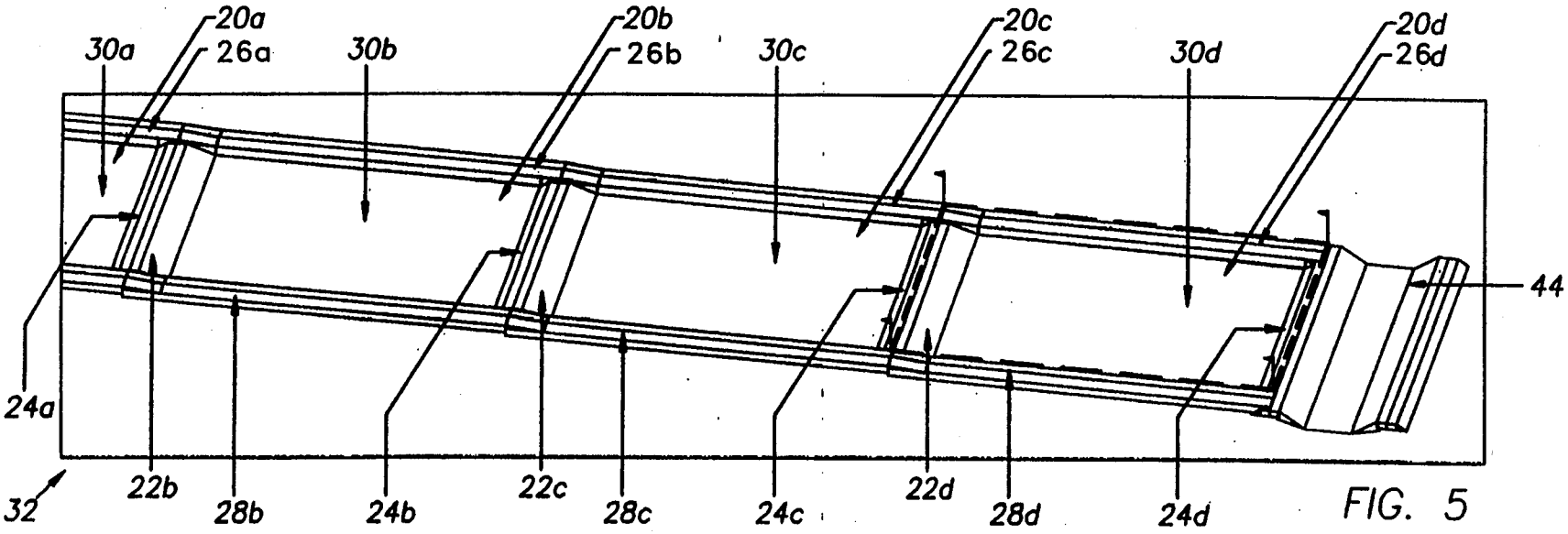
FIG. 5 is a perspective view of the invention shown in FIG. 4.

FIGS. 4 and 5 show the stringing of units 20*a–d* together weir 22*a–d*, to weir 24*a–d*, etc., in linear fashion to form a string 32. Normally a string 32 will consist of all units 20 contained by a continuous set of parallel borders 26, 28 beginning at the high end of the field (not shown) and proceeding down to a natural or constructed watercourse 44. One unit 20 follows after another in the chosen string 32 alignment until a natural watercourse or constructed drainageway 44 is reached. In forming a string 32 of units 20*a–d*, the egress weir 24 of the uppermost unit becomes or transcends into the ingress weir 22 of the second unit, and the process continues until the string 32 is complete.

If the string 32 passes (temporary negative slope) through a minor low point in the field (swale) so that, for example, the third unit (not shown) in the string is actually lower than the downstream fourth unit (not shown), then the borders 26, 28 of the upstream low lying unit(s) 20 could be constructed higher than normal to prevent water from overtopping them before it runs over the egress weir 24 of the slightly higher downstream unit(s) following it in the string 32. In this case, the ingress and/or egress weirs of the upstream low lying unit(s) could be lower than weirs on the higher downstream unit(s).

Any and all water that overflows any unit 20 is confined to the string 32, which effectively divides and creates many small, separate, independent mini watershed units 20 to the drainageway 44. Thus, referring to FIG. 13, the broad, branching water courses (rills) (not shown) that naturally occur in all sloping fields 12 are twice subdivided (first by units 20, secondly by strings 32) before they ever reach the major internal watercourses 46 (swales, gullies, or streams) of the field 12. The best economical alignment for strings 32 for mechanized farming would be straight and parallel to one of the side boundaries 26 of the field 12, as depicted in FIG. 1. On level or gently sloping land it may be possible to use a completely square grid of units 20 and strings 32, allowing maximum convenience to mechanized equipment. Even when aligned otherwise, the field 12 can still be cultivated in parallel strips or strings 32, and the "point row" effects are eliminated (since the topography of a field is not perfectly planar, and contour lines are not parallel the rows planted. on the contours must adapt to ridges and valleys by nonparallel spacing resulting in intermittent pockets of short rows called "point rows," 15 see FIG. 1).

Under certain conditions (such as strongly sloping, or undulating land topography) straight strings 32 may not be sensible or desirable. Directional alignment of the uppermost unit does not necessarily determine the alignment of the entire string 32, which may change in alignment as it proceeds in a general downslope direction in order to best accommodate the topography. Regardless of the directional alignment of a string 32, adjacent strings 32 are designed to be collateral.

Figure 6:
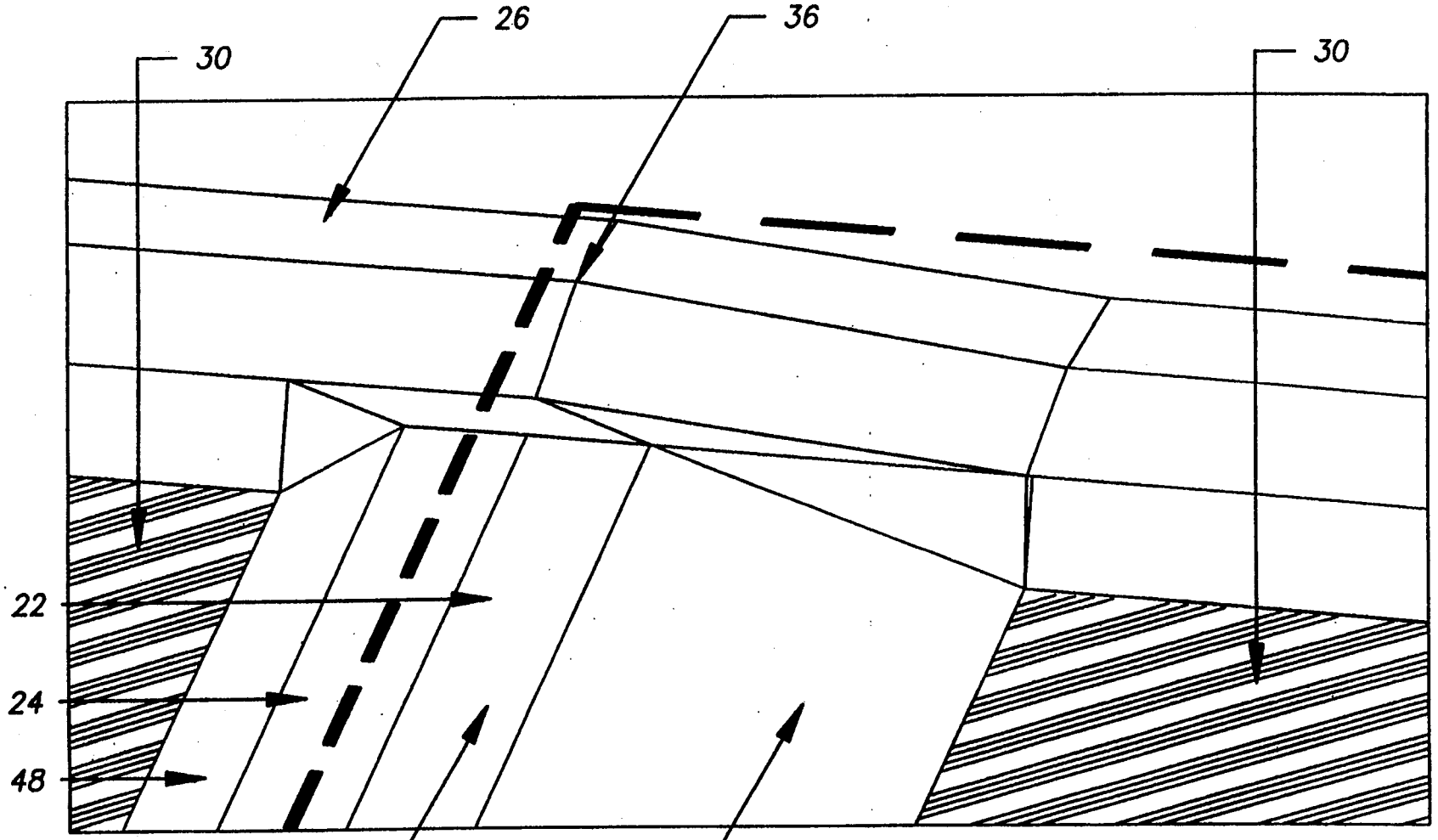
FIG. 6 is a perspective view of an egress weir and ingress weir along with the borders of consecutive watershed units.
Figure 7:
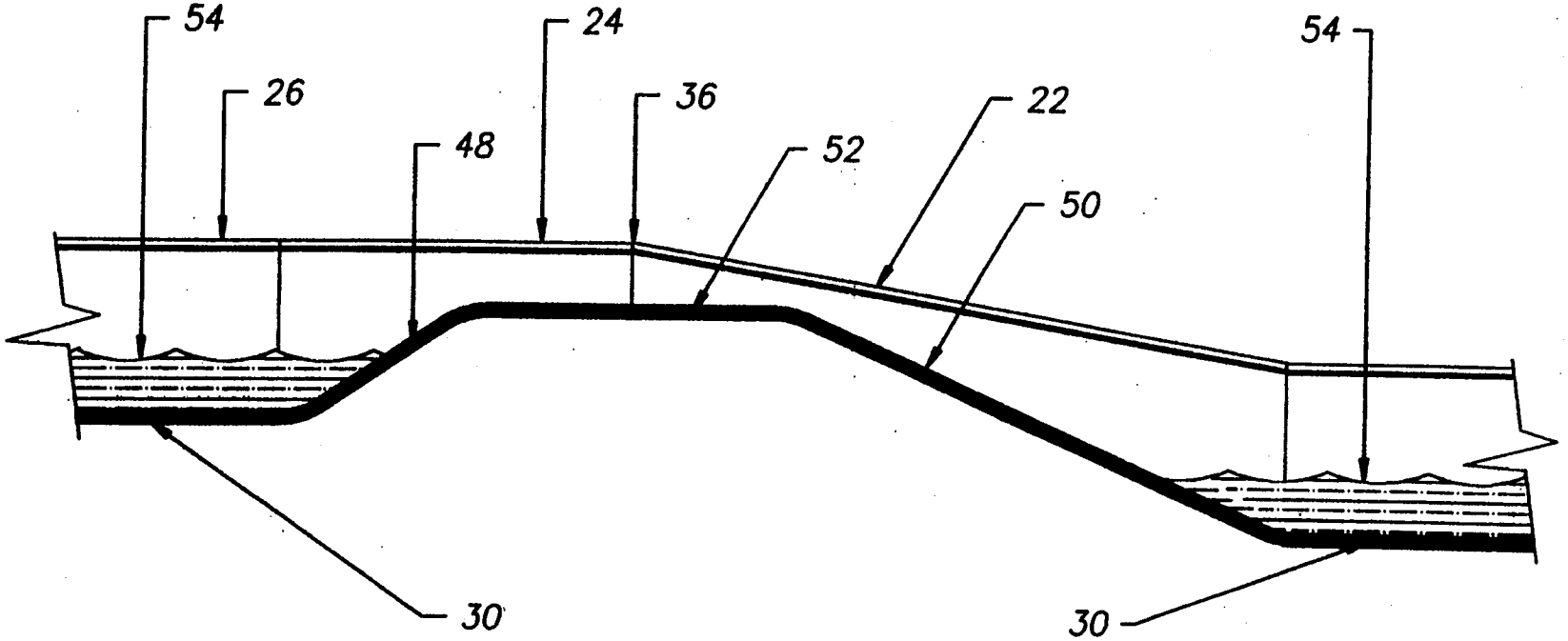
FIG. 7 is an elevational section view of the ends of two consecutive watershed units depicting the containment of water within the units.

The earthen weir 22, 24 is an integral part of the system. If desirable to better accommodate movement of machinery, the upslope side 48 or the downslope side 50 can be constructed relatively wide as seen in FIG. 6 and FIG. 7. FIG. 6 shows the border 26 of portions of two units that join at the dash line over the top surface 52 of the weir 22, 24. The upslope side 48, downslope side 50 and top surface 52 are transition surfaces which may be plane surfaces or some other machine friendly surface. Note that the top 52 of the weir 22, 24 is slightly lower in elevation than the top 36 of the border 26 so that in case the basin 30 becomes filled, water will overflow the unit 20 by way of the weir 22, 24, not by way of the border 26 of the unit 20. The dash line designates the point where the upslope unit (pictured to the left) and the downslope unit (pictured to the right) meet to form a portion of a string. The upslope or ascending surface 48 of the weir 22 terminates the basin 30 of the upslope unit, while the downslope or descending surface 50 begins the basin 30 of the downslope unit. The top 52 of the weir 22, 24 can be formed as a surface that is approximately level in order to maximize washout protection.

If overflow does occur due to rare major rainfall events, it will move in a wide, very shallow stream over the top surface 52 of the level weir 22, 24. The broad shallow stream will tend to impede downslope velocity.

Soil particles that may be picked up in the process will tend to settle out when the flow velocity of the stream is greatly reduced and impeded by the basin 30 of the next succeeding downslope unit.

By eliminating rill flow, and reducing the height of the outflow, the shaped weir 22, 24 greatly diminishes the power of gravity driven water to erode soil.

FIG. 7 shows the same weir 22, 24 in longitudinal section, showing the upslope and downslope basins 30 holding a considerable quantity of water 54 immediately following a rain. The weir 22, 24 pictured has the upslope 48 asymmetric to the downslope 50, but this geometry is unessential. It is essential to the design that the top 52 of the weir 22, 24 approach true level, so that any water that flows from one basin 30 to another will be in a thin level sheet. Only rarely will water 54 accumulate in the level basin(s) 30 of the unit 20 to the depth that will begin to overflow.

As depicted in FIG. 7, the basins 30 formed by the weirs 22, 24 completely contain the water precipitated by a one year rain in the arid, semiarid, and portions of the sub-humid climatic regions.

After the depth of the water in the basin 30 exceeds a few centimeters in depth, it dissipates the kinetic energy of the raindrops in the ponding areas. This is an important consideration concerning potential soil erosion, for the kinetic energy of raindrops is the primary agent dissolving soil particles into the water sheeting over unprotected soil surfaces. The weir 22, 24 and border surfaces 26, 28 remain exposed, but dislodged soil flows into the adjacent basin 30 where it settles out in the still water.

After rainfall begins, water immediately begins to be absorbed by, and move down into the soil, which greatly increases total ponding capacity of the unit 20 in longer duration rains. Extreme intensities of precipitation rarely last more than 15 minutes and even major precipitation events (ten year rains) usually span a few hours' time, significantly increasing total ponding capacity and particularly in unsaturated soil.

Figure 8:
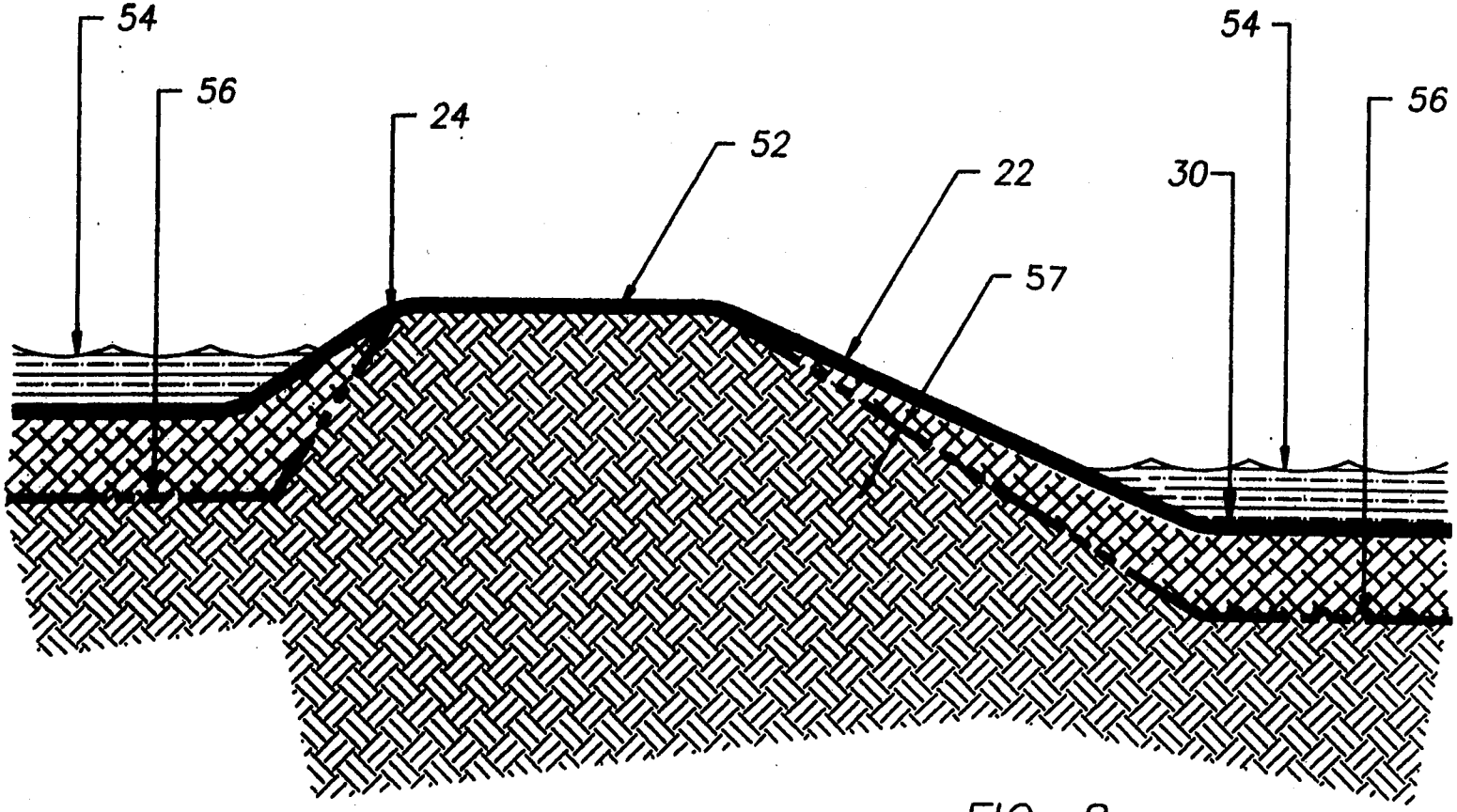
FIG. 8 is a view similar to FIG. 7 showing infiltration of the soil by the water.

FIG. 8 (no border shown) also shows a longitudinal section of a weir 22, 24, and the water level in adjacent basins 30 after a major rainfall event. Also pictured is the depth of the saturated portion 56 of a heavy soil with a low time absorption coefficient, and the relative drier soil 58 below. Many soils under most conditions would be wetted much deeper by the time this depth of water 54 had accumulated in the basin 30. Water soluble chemicals applied to crop plants or soil within the unit 20 will tend to move to the basin 30 of the unit 20 and to move down with the water saturated front 56, or, more likely, partition out among the internal colloids of the saturated heavy soil.

Figure 9:
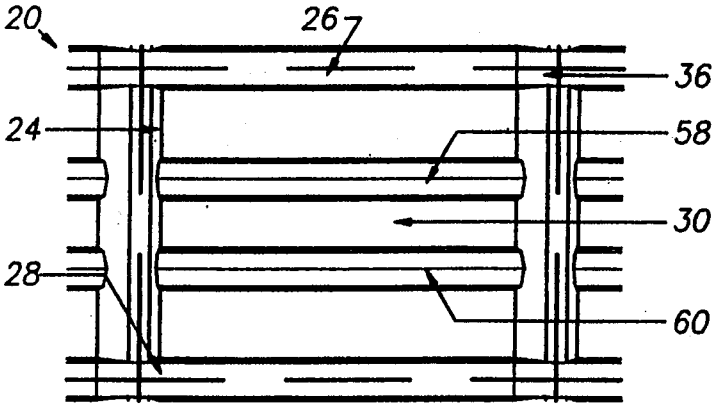
FIG. 9 is a top view of another embodiment of the invention including implemented tracks.
Figure 10:
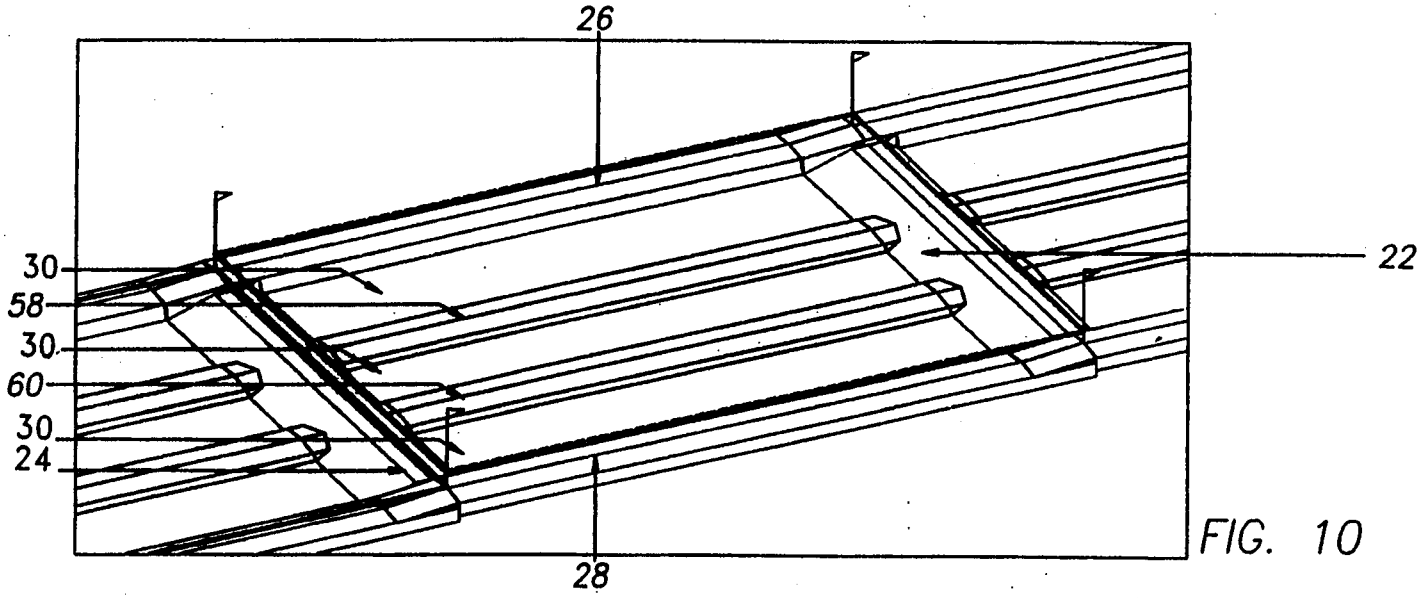
FIG. 10 is a perspective view of the embodiment shown in FIG. 9.

FIGS. 9 and 10 show how the unit 20 can be modified by the addition of implement tracks 58, 60. Although two tracks 58, 60 are shown, the number of tracks can vary. A single unit 20 is still the area under the plane described by the dash line but is now more complex, with upraised tracks 58, 60 running through the now divided basin 30. This type of unit 20 is termed a "track unit". These tracks 58, 60 serve several important purposes. They dry out much faster after a rain, and therefore accommodate movement of mechanized equipment through the unit 20 and along the string 32 before the bottom of the basin 30 is completely dry.

The tracks 58, 60 are designed to facilitate the use of all types of farm equipment, and thus can be kept in place as a year-round structure. With the proper equipment, the tracks 58, 60, borders 26, 28 and weirs 22, 24 need never be moved, and can easily be slightly modified and given minor repairs each time they are cultivated or when necessary. Thus, the unit 20 can be kept in place as permanent protection against erosion. In other types of conservation tillage, there are intervals when the land is less than adequately protected, while this system provides protection at all times. Much of the erosion damage in the USA as well as other regions occurs at such "vulnerable periods" on land that is ordinarily well managed.

A corollary effect of permanent protection is that the rigorous constraints of minimum tillage and no-tillage are relaxed without risk or penalty. This can have significant economic and environmental benefits, if, for example the farmer is free to sometimes cultivate for weed control instead of always having to apply herbicide, as in no-till farming. Furthermore, herbicides may not always give a complete spectrum of weed control.

In regions where wind erosion is a problem (due to prevailing winds, soil type, unprotected fields, etc.), the strings 32 should be constructed as nearly perpendicular to the prevailing wind direction as topography will allow. This way, the tracks 58, 60 and borders 26, 28 provide ridges to oppose the force of the wind, greatly reducing the amount of windblown soil leaving the field, as various sized soil particles sift out of the air, larger particles to the windward side, and smaller particles to the leeward side. The elevation of tracks 58, 60 and borders 26, 28 above the basin 30 could be increased to provide additional protection from wind erosion. Likewise, the inter-spacing of tracks 58, 60 and borders 26, 28 could be decreased.

The inclusion of tracks 58, 60 tends to impinge upon the water holding capacity of the basin 30, but this can be compensated in several ways: A. The tracks 58, 60 may not always necessarily have to be as high as the weir 22, 24. In many cases, lower tracks may be adequate for the purpose, and lower tracks will not reduce capacity as much as higher tracks. B. Deepening the portions of the basins 30 between the tracks 58, 60 and/or between tracks 58, 60 and borders 26, 28 may be an acceptable option. Deep basins 30 concentrate the retained water for the whole unit 20 into a fractional part of the unit 20. This fact has important consequences for water use efficiency for crops grown on the unit 20 for the water will be stored deeper under the basins 30, and be better protected against evaporation loss, and a greater proportion will therefore be available for crop use. This contrasts with uniform standard furrows where water is stored to more or less uniform depth. This option would make the undulation from ridge crest to basin trough much more prominent, which could be particularly desirable in areas where wind erosion is the greatest erosion threat. The bottoms of the standard basins 30 need to be essentially level only in longitudinal section (ingress weir 22 to egress weir 24). There is no compelling reason that the basin(s) 30 be level in cross section (border 26 to border 28). In cross section, deeper furrows could be cut to hold additional water, and to increase the vertical difference between the bottom of the basin 30 and the top of the track 58, 60. Furthermore, neither the tracks 58, 60 nor the borders 26, 28 are required to be square in cross sectional profile. Both tracks 58, 60 and borders 26, 28 could be constructed higher in the center and slope down to low shoulders. With the center of the borders 26, 28 high enough to maintain the integrity of the basin 30, the sides of the borders 26, 28 and tracks 58, 60 could slope down low enough that the high water level in the basin 30 could cover part of the tracks 58, 60 and borders 26, 28 at the point where weir overflow commences, also increasing the containment capacity of the basin 30.

The permanent tracks 58, 60 also set up a permanent equipment or machinery wheel compaction zone in the optimal position. This is desirable for several reasons. First, restricted compaction has been shown to increase yields. Secondly, a compaction zone on tracks 58, 60 is away from the main water retention area where crop roots are expected to flourish. Third, compaction is less damaging on dry soil, and the tracks 58, 60 should be dry while the basin portion of the unit 20 is still moist.

Figure 12:
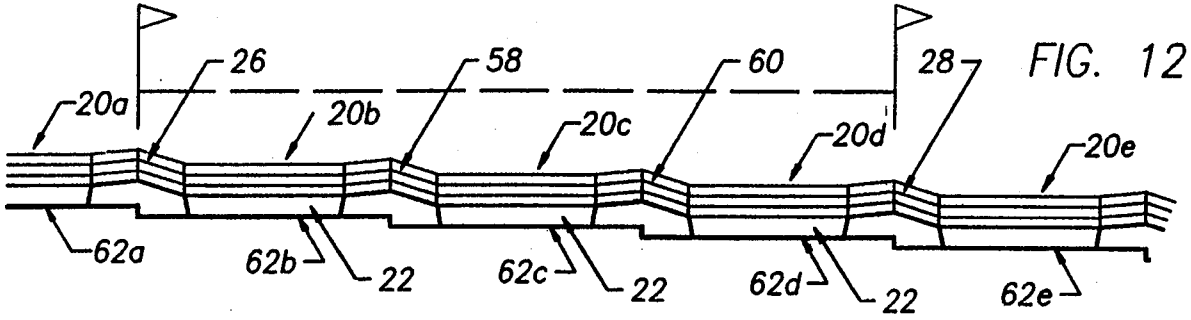
FIG. 12 is a cross-sectional end view of the embodiment shown in FIG. 11.

FIGS. 11 and 12 introduce the concept of micro-units 20*a–e*, in which the tracks are raised as high as the borders. Tracks 58, 60 may be raised as high as borders 26, 28 in the standard unit 20 which could allow separate sub-basins 62*a–e* in the unit 20 from border 26 to track 58, track 58 to track 60, and track 60 to border 28—each of which is not required to be level with the other. The dashed line delimits the area of the original track unit 20. The corners of the original unit 20 are indicated. Borders 26, 28 have been eliminated and replaced by tracks or have become the equivalent of elevated tracks 58, 60 overtopping the weirs 22, 24. Since the tracks/borders 26, 28, 58, 60 overtop the weirs, three completely separate micro-units 20*b–d* or subbasins 62*b–d* are created out of the area of the single basin 30 described in earlier types of units 20. Since the subbasins are completely separate, it is no longer necessary that they should lie on a single level plane. FIG. 12 shows a cross sectional end view of micro-units 20*a–e*. Note that this type of unit construction can accommodate a significant side slope depicted as left to right in FIG. 12. In other words, implemented tracks within an ordinary unit can vary in height to create subbasins and/or substrings within an ordinary basin or string, respectively.

The basins 62*a–e* of micro-units are constructed adjacent to each other, the weirs in the illustrated collateral strings join end to end and the adjacent collateral tracks in the adjoining collateral strings will form a shared basin with the companion micro-units lying side by side in adjacent collateral sub-strings. The micro-unit string construction will be particularly useful when slopes are so great that strings of units cannot be aligned fully downslope, but have to conform more nearly to the contour of the land which very often includes both downslope and sideslope. Each basin 62*a–e* will still be constructed essentially level in the longitudinal direction, and will be contained on the downslope side by the weir as before, but in this case the relative elevation of the tracks/borders 26, 28, 58, 60 will provide or define the sideslope containment.

Figure 13:
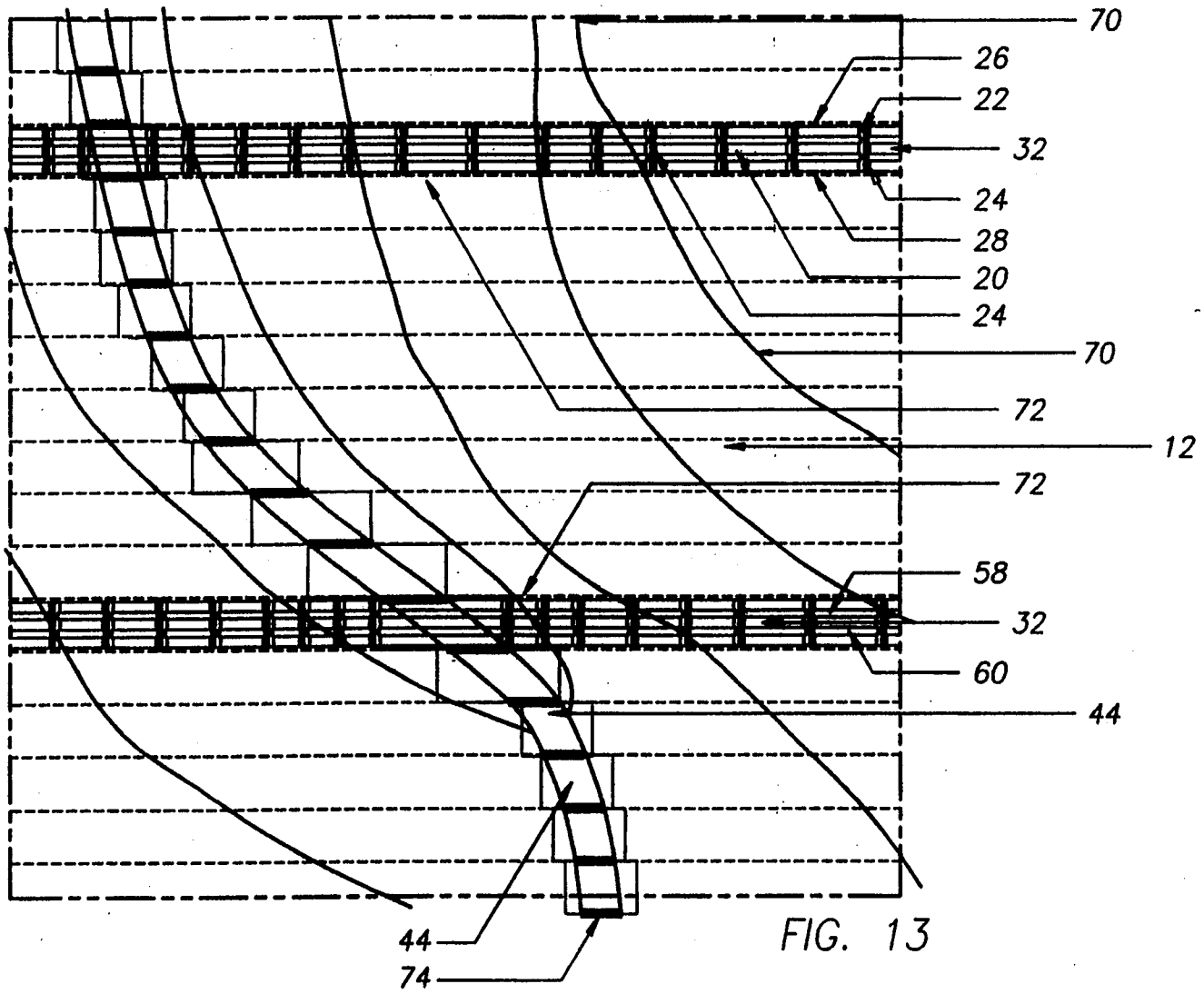
FIG. 13 is a plan view of an agricultural area depicting watershed units and strings.

The final downslope unit of a string will normally culminate in a natural water course or diversion channel, which will obviously be lower along its progression than the immediately adjacent areas of the field. In many upslope areas where erosion has not yet become a critical problem, the diversion channel can be formed into units that will not greatly impede farming operations, or that can even be partially farmed as part of the string(s) mentioned above. FIG. 13 shows a map of one possible construction representing only a very small portion of a field 12 near the drainageway 44. Curved lines 70 indicate true contours that describe the topography of the field. The areas 72 between parallel dashed lines generally indicate collateral strings 32 of units 20 that move from higher levels to lower levels across the natural watercourse. Although only two areas 72 are detailed with lines representing units 20 and strings 32 it is to be understood that the entire field 12 should implement lines and strings. Units 20 within the strings 32 may vary in length from ingress wier 22 to egress weir 24, due to variation in slope at different portions of the field 12.

Unless the drainageway or diversion channel 44 is so short and level that erosion is not a problem, it can be constructed in a manner analogous to the basic units, with weir construction at regular intervals along its course. The watercourse weirs 74 must be vegetated in order to retain their integrity when water is flowing, and it must be anticipated that in semiarid areas excess water must be provided to keep the vegetation on the weirs in good condition. Therefore, the channel 44 between weirs 74 should slope slightly (as in the dashed line in FIG. 15) in order that water from small rains may accumulate in the area immediately adjacent to the weir 74. A longitudinal section of a hypothetical diversion channel 44 is shown in the diagram, which was adapted from the design of a Zingg terrace. In normal rainfall events, water is harvested in portions of the channel to be delivered to the weir area to keep the vegetation at critical points in more vigorous growth, ready to withstand erosion when rare overflow events occur.

Figure 14:
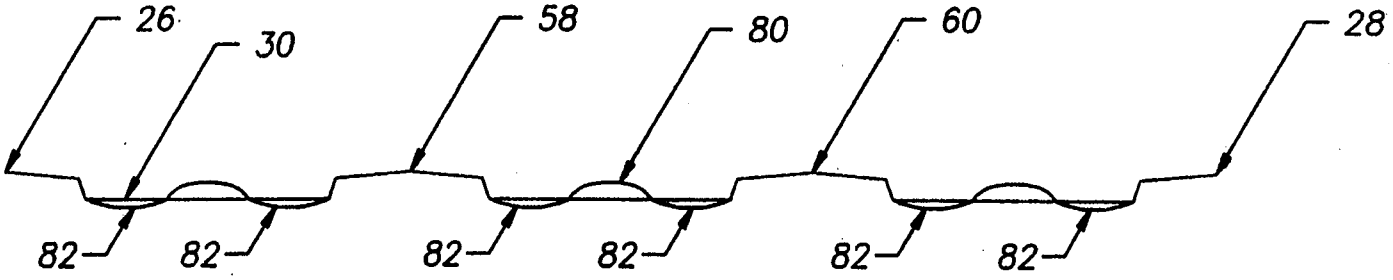
FIG. 14 is a cross-sectional elevational view of another embodiment of the invention utilizing furrows and rows.

FIG. 14 shows an additional modification of the basic track unit shown in FIGS. 9 and 10. The basin area between the tracks and borders does not necessarily need to remain level in cross-section, but can be temporarily modified for crop needs. In FIG. 14 the level basin bottom 30 (indicated by the solid line) has been modified by the construction of rows 80 and furrows 82 between the tracks 58, 60 and borders 26, 28. This still retains the water containment capacity of the basin 30, but creates a better environment for row cropping.

Figure 15:
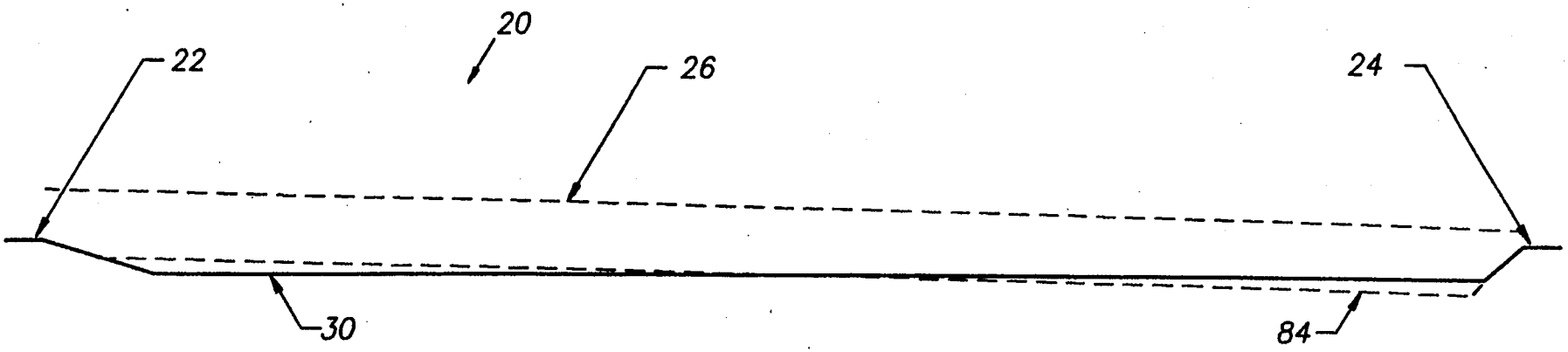
FIG. 15 is a longitudinal elevational view of another embodiment of the invention where the watershed unit basins are sloped.

FIG. 15 depicts how units could be modified to have a sloping basin 84 (dashed line), rather than a level one 30 (solid line). This type of unit might be advantageous for certain situations where it is desirable to concentrate ambient precipitation in a small area. This might occur where rainfall is insufficient for economic plant growth across an entire watershed unit 20, but where two-fold or greater concentration of precipitation might produce economic plant growth in a concentrated area. This type of unit would also prevent erosion, and would be less expensive to construct than the standard unit, since it follows the slope more closely and requires less excavation.

Figure 16:
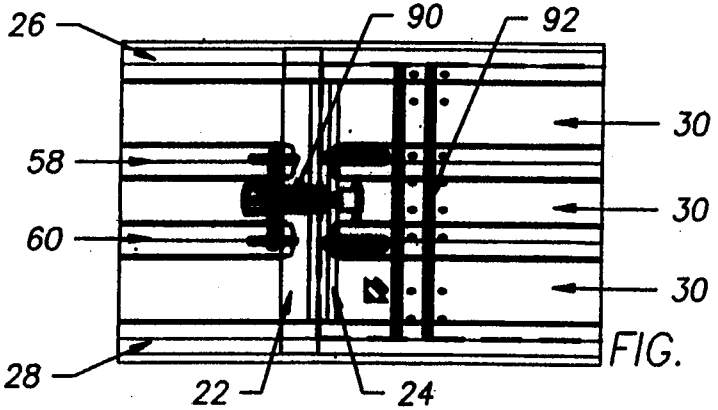
FIG. 16 is a top view of a tractor and plow within a string including implemented tracks.
Figure 17:
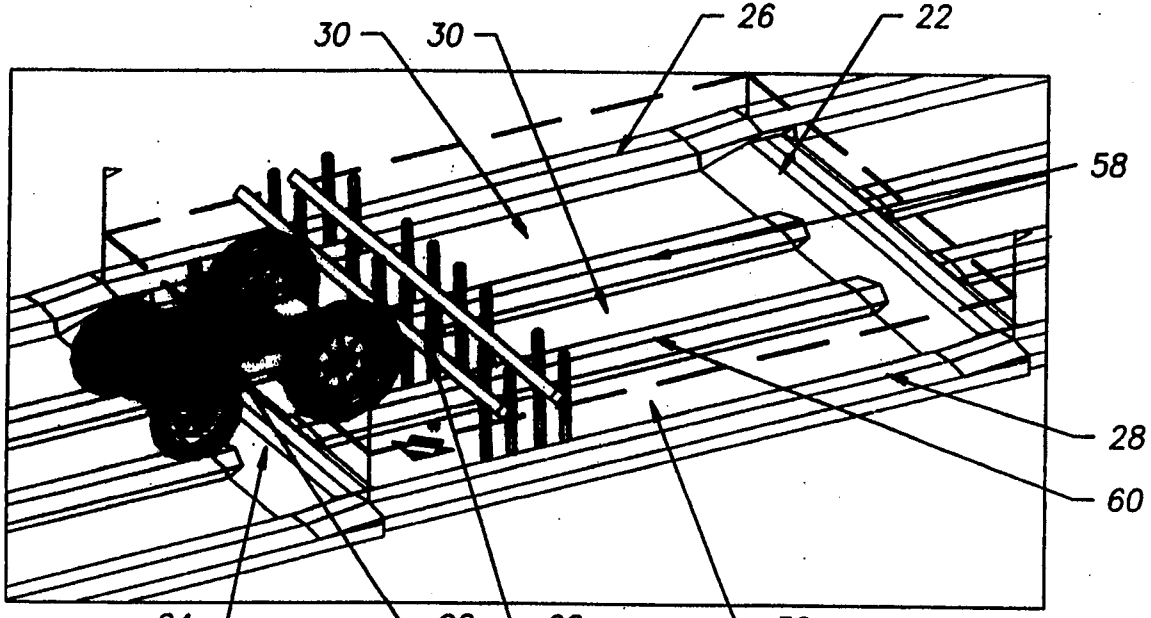
FIG. 17 is a perspective view of FIG. 16.

Referring to FIG. 16 and 17 a tractor 90 and plow 92 are shown working a string 32 as the tractor 90 is crossing a weir 22, 24, and the plow 92 is working the basin 30. The plow 92 can also be adapted to work the implemented tracks 58, 60 and borders 26, 28. As shown, the implemented tracks 58, 60 are preferably spaced to correspond with the wheel base of the tractor 90, so that the driver can use the implemented tracks 58, 60 as a path or track when working the field. Obviously, planting will occur in the basin 30 and may also occur on the tracks 58, 60, borders 26, 28, as well as the weirs 22, 24. Modifications could be made to the plow 92 to maintain the integrity of weirs 22, 24, borders 26, 28, and tracks 58,60.

As an example, the borders 26, 28 shown may have an elevation in the range of 8 inches above the basin 30, the weirs 22, 24 being about 6 inches above the basin 30, and the tracks 58, 60 being about 4 inches above the basin 30. This example is not intended to be a limitation since elevational dimensions are dependent upon slope of the field, prevailing winds, anticipated precipitation, soil type, crop type, etc.

It is believed the optimum water retention system works best in combination with minimum tillage techniques. The material used to construct weirs, borders, tracks, etc. preferably comes directly from the immediate vicinity upon which the barriers are formed. With proper modification of farm equipment, it is believed that maintenance of the barriers will only be required after several years. It is believed this optimum water retention system will work well in regions having an average annual rainfall in the range of 12–30 inches, but should be applicable to higher rainfall areas vulnerable to water erosion, and lower rainfall areas vulnerable to desertification.

The preferred embodiment of this invention has been shown and described above. It is to be understood that minor changes in the details, construction, and arrangement of the invention may be made without departing from the spirit or scope of the invention as claimed.

What is claimed is:

1. An optimum water retention system for retention of virtually all precipitation impinging on an agricultural field and uniformly dispersing the precipitation into the soil virtually at the point of impingement, where the system prevents soil erosion by preventing runoff of suspended soil particles and prevents non-source point pollution by retaining chemicals at their point of application, comprising:

a passive permanent farmable symmetrical grid encompassing said agricultural field including any sloped portions of said field, including a plurality of level-bottom depressions of uniform width across a direction of machine travel, sufficient to accommodate any agricultural implements for the field, said depressions having borders designed to be machine-friendly, whereby the agricultural implements are able to traverse the agricultural field, crossing in and out of said depressions while performing normal operations; said borders including two side borders parallel to the direction of machine travel and two end borders perpendicular to the direction of machine travel, wherein said side borders have a steep side wall, from the bottom of said depression to the top of said side borders, having a vertical rise of at least three vertical units per one horizontal unit; while said end borders have dirt ramps of mild slope connecting said depression bottom and tops of said end borders, having a vertical rise of less than one vertical unit to two horizontal units, so as to avoid a speed bump effect of the implements passing over said end borders whereby said depressions shall be ordinarily dry and capable of holding all normal ambient precipitation; further including at least two upraised tracks parallel to said side borders implemented into said depression bottom to enable greater farming efficiency.

2. An optimum water retention system for retention of virtually all precipitation impinging on an agricultural field and uniformly dispersing the precipitation into a soil profile virtually at the point of impingement, where the system prevents soil erosion by preventing runoff of suspended soil particles and prevents non-source point pollution by retaining chemicals at their point of application, comprising:

a passive permanent, multi-year, year-round, farmable symmetrical string comprising at least three individual uniform width watershed units closely conjoined across the agricultural field from one end of the field to another end, wherein said units form a string from a starting point, on a higher end of the field, to an ending point on the other end of the field, or at an intervening watercourse, wherein each of said watershed units of said symmetrical string includes:

a basin having a level bottom delineated by a first and a second upraised border;

said first border located on one side of said basin, said second border located on a second side of said basin opposite said first border, an overflow ingress weir extending across one end of said basin, an overflow egress weir extending across another end of said basin opposite said ingress weir; wherein said egress weir becomes the ingress weir for a following basin, to consecutively join said watershed units, said first border, said second border, said ingress weir, and said egress weir each having a top surface, with the top surface of said weirs being generally level and lower than the top surface of said borders thereby forcing sheet flow over said egress weir of any water leaving said basin; wherein said borders are parallel to a direction of machine travel through said field, and said borders include two sidewalls from said basin bottom to the top surface of said borders, each having a vertical rise at least three vertical units to one horizontal unit; said ingress weir including a trailing edge; said egress weir including a leading edge, each leading and trailing edge constructed as inclined planes connecting said basin bottom and the top of said ingress weir and said egress weir, respectively, each having a vertical rise of less than one vertical unit to two horizontal units, so as to avoid a speed bump effect of the implements passing over said ingress and egress weirs; wherein said string has a width from border to border sufficient to accommodate the necessary agricultural implements for said field, and is aligned to accommodate requirements of mechanical farming efficiency, and reduce vulnerability to wind erosion; wherein said basins include two upraised tracks collateral to said side borders for greater farming efficiency and acceptability; and wherein said basins are ordinarily dry and capable of holding all normally occurring natural precipitation.

3. The optimum water retention system according to claim 2 wherein said string is an initial string bordering arid below an untreated upper field and due to gravity accepts any runoff from the untreated upper field into said basins whereby excessive inflow of any water is guided down said string to the end point of the field or intervening watercourse via the sheet flow over said overflow egress weir into a following basin down said string, and a leading ingress weir at an edge of the field accepts the runoff from the untreated upper field into said basin and any excessive runoff in the optimum water retention system flows down said string until all water is contained, released into a watercourse, or released to a lower field through a trailing egress weir.

4. An optimum water retention system for retention of virtually all precipitation impinging on an agricultural field and uniformly dispersing the precipitation into a soil profile virtually at the point of impingement, where the system prevents soil erosion by preventing runoff of suspended soil particles and prevents non-source point pollution by retaining chemicals at their point of application, comprising:

a passive permanent, multi-year, year-round, farmable symmetrical string comprising at least three individual uniform width watershed units closely conjoined whereby in aggregate a complete watershed is made within the agricultural field from a high point of the agricultural field to an end point, or intervening watercourse; wherein each of said watershed units of said symmetrical string includes:

a basin delineated by a first and a second upraised border;

said first border located on one side of said basin, said second border located on a second side of said basin opposite said first border, an overflow ingress weir extending across one end of said basin, an overflow egress weir extending across another end of said basin opposite said ingress weir; wherein said egress weir becomes the ingress weir for a following basin, to consecutively join said watershed units, said first border, said second border, said ingress weir, and said egress weir each having a top surface, with the top surface of said weirs being generally level and lower than the top surface of said borders thereby forcing sheet flow over said egress weir of any water leaving said basin; wherein said borders are parallel to a direction of machine travel through said field, and said borders include two sidewalls from said basin bottom to the top surface of said borders, each having a vertical rise of at least three vertical units to one horizontal unit; said ingress weir including a trailing edge; said egress weir including a leading edge, each said leading and trailing edge constructed as inclined planes connecting said basin bottom and the top of said ingress weir and said egress weir, respectively, each having a vertical rise of less than one vertical unit to two horizontal units, so as to avoid a speed bump effect of the implements passing over said ingress and egress weirs; wherein said string has a width from border to border sufficient to accommodate the necessary agricultural implements for said field, and is aligned to accommodate requirements of mechanical farming efficiency, and reduce vulnerability to wind erosion; wherein said weirs are ordinarily dry and hold all normal ambient precipitation in said basins, and allow the precipitation to infiltrate into the soil throughout said basins and into the soil of said weirs and said borders to facilitate plant growth in said basins and on said borders and said weirs, while forcing runoff from an extreme rainfall event to leave each said basin by sheet flow over said overflow egress weirs.

5. The optimum water retention system according to claim 4, wherein each of said basins includes a level bottom which comprises a lower elevation area between said trailing edge of said ingress weir and said leading edge of said egress weir and between said first border to said second border to aid in the uniform infiltration of all ambient precipitation into the soil profile over said complete watershed units wherein an adjoining basin bottom will normally be at a different elevation.

6. The optimum water retention system according to claim 4, wherein each of said basins has a length and an elevation difference between said ingress weir and said egress weir dependent on the length, the elevation difference and a slope of the agricultural field along said string at an interval where said basin is positioned.

7. The optimum water retention system according to claim 4 further including at least two upraised tracks implemented onto a bottom of each of said basins and collateral to said first and said second borders of said watershed units whereby wheel compaction is restricted to a defined area and reduces an elevation transition difference which occurs by reducing the amount of elevation transition of a wheel moving on said tracks through said basin to said top surface of said weirs, said tracks enable quicker entry for wheeled equipment into the field following a rain due to quicker drying of said tracks.

8. The optimum water retention system according to claim 7, wherein said tracks are upraised to an elevation less than the elevation of said borders.

9. The optimum water retention system according to claim 7 wherein said tracks define a separate subbasin between each of said borders and each of said tracks and between said tracks, wherein each of said subbasins can be at a different elevation than an adjoining subbasin.

10. The optimum water retention system according to claim 7, wherein said tracks are upraised to an elevation proximate the elevation of said top surfaces of said borders and above the elevation of said top surfaces of said weirs within each of said watershed units wherein said tracks define a separate subbasin between each of said borders and each of said tracks and between said tracks, wherein each of said subbasins can be at a different elevation than an adjoining subbasin wherein said ingress and said egress weirs of each of said subbasins can be at a different elevation than an adjoining weir.

11. The optimum water retention system according to claim 10, wherein said first border and said second border are a third and a fourth track implemented into said basins collateral to said first two tracks.

12. The optimum water retention system according to claim 4, further including a row and a furrow implemented into said basin collateral to said borders.

13. The optimum water retention system according to claim 4 wherein the direction of said string is secondarily dependent upon the slope of the field but is primarily dependent upon an optimization of the field for efficient and inexpensive farming operations and consideration of wind erosion, allowing the direction of said string to be aligned in any relation to the slope from along near level contours to directly down moderate slopes.

14. The optimum water retention system according to claim 4, wherein said basin bottoms are sloped to concentrate the ambient moisture to a fractional portion of the basin in severe moisture deficient areas to form a symmetrical grid of crop sustaining areas for plant coverage at regular intervals to diminish wind erosion and by design eliminate water runoff while allowing the area to produce economic plant growth.

15. An optimum water retention system for retention of virtually all precipitation impinging on an agricultural field and uniformly dispersing the precipitation into a soil profile virtually at the point of impingement, where the system prevents soil erosion by preventing runoff of suspended soil particles and prevents non-source point pollution by retaining chemicals at their point of application, comprising:

a passive permanent, multi-year, year-round, farmable system wherein a plurality of collateral uniform width strings are joined together to form a symmetrical grid over the complete agricultural field; wherein each of said strings shares a border with each succeeding string as the system progresses through the agricultural field; each string having at least three individual uniform width watershed units closely conjoined whereby in aggregate a complete watershed is made within the agricultural field from a high point of the agricultural field to an end point, or intervening watercourse; wherein each of said watershed units of said symmetrical strings includes:

a basin delineated by a first and a second upraised border;

said first border located on one side of said basin, said second border located on a second side of said basin opposite said first border, an overflow ingress weir extending across one end of said basin, an overflow egress weir extending across another end of said basin opposite said ingress weir; wherein said egress weir becomes the ingress weir for a following basin, to consecutively join said watershed units, said first border, said second border, said ingress weir, and said egress weir each having a top surface, with the top surface of said weirs being generally level and lower than the top surface of said borders thereby forcing sheet flow over said egress weir of any water leaving said basin; wherein said borders are parallel to a direction of machine travel through said field, and said borders include two sidewalls from said basin bottom to the top surface of said borders, each having a vertical rise of at least three vertical units to one horizontal unit; said ingress weir including a trailing edge; said egress weir including a leading edge, each said leading and trailing edge constructed as inclined planes connecting said basin bottom and the top of said ingress weir and said egress weir, respectively, each having a vertical rise of less than one vertical unit to two horizontal units, so as to avoid a speed bump effect of the implements passing over said ingress and egress weirs; wherein each said string has a width from border to border sufficient to accommodate the necessary agricultural implements for said field, and is aligned to accommodate requirements of mechanical farming efficiency, and reduce vulnerability to wind erosion, wherein said weirs are ordinarily dry and hold all normal ambient precipitation in said basins, and allow the precipitation to infiltrate into the soil throughout said basins and into the soil of said weirs and said borders to facilitate plant growth in said basins and on said borders and said weirs, while forcing runoff from an extreme rainfall event to leave each said basin by sheet flow over said overflow egress weirs.

16. The optimum water retention system according to claim 15, wherein each of said basins includes a level bottom which comprises a lower elevation area between said trailing end of said ingress weir and said leading edge of said egress weir and between said first border to said second border to aid in the uniform infiltration of all ambient precipitation into the soil profile over said complete watershed units wherein an adjoining basin bottom will normally be at a different elevation.

17. The optimum water retention system according to claim 15, wherein each of said basins has a length dependent and an elevation difference between said ingress weir and said egress weir on the length, the elevation difference and a slope of the agricultural field along said string at an interval where said basin is positioned.

18. The optimum water retention system according to claim 15 further including at least two upraised tracks implemented onto a bottom of each of said basins and collateral to said first and said second borders of said watershed units whereby wheel compaction is restricted to a defined area and reduces an elevation transition difference which occurs by reducing the amount elevation transition of a wheel moving on said tracks through said basin to said top surface of said weirs, said tracks enable quicker entry for wheeled equipment into the field following a rain due to quicker drying of said tracks.

19. The optimum water retention system according to claim 18, wherein said tracks are upraised to an elevation less than the elevation of said borders.

20. The optimum water retention system according to claim 18 wherein said tracks define a separate subbasin between each of said borders and each of said tracks and between said tracks, wherein each of said subbasins can be at a different elevation than an adjoining subbasin.

21. The optimum water retention system according to claim 18, wherein said tracks are upraised to an elevation proximate the elevation of said top surfaces of said borders and above the elevation of said top surfaces of said weirs within each of said watershed units wherein said tracks define a separate subbasin between each of said borders and each of said tracks and between said tracks, wherein each of said subbasins can be at a different elevation than an adjoining subbasin wherein said ingress and said egress weirs of each of said subbasins can be at a different elevation than an adjoining weir.

22. The optimum water retention system according to claim 21, wherein said first border and said second border are a third and a fourth track implemented into said basins collateral to said first two tracks.

23. The optimum water retention system according to claim 15, further including a row and a furrow implemented into said basin collateral to said borders.

24. The optimum water retention system according to claim 15 wherein the direction of said string is secondarily dependent upon the slope of the field but is primarily dependent upon an optimization of the field for efficient and inexpensive farming operations and consideration of wind erosion, allowing the direction of said string to be aligned in any relation to the slope from along near level contours to directly down moderate slopes.

25. The optimum water retention system according to claim 15, wherein said basin bottoms are sloped to concentrate the ambient moisture to a fractional portion of the basin in severe moisture deficient areas to form a symmetrical grid of crop sustaining areas for plant coverage at regular intervals to diminish wind erosion and by design eliminate water runoff while allowing the area to produce economic plant growth.

26. The optimum water retention system according to claim 15, wherein said plurality of collateral strings are oriented relative to a direction of prevailing winds so as to minimize wind erosion of the optimum water retention system in areas where wind erosion is a major form of soil erosion.

* * * * *